US007913469B2

(12) United States Patent
Qu et al.

(10) Patent No.: US 7,913,469 B2
(45) Date of Patent: Mar. 29, 2011

(54) CONCRETE LOAD-BEARING WALL WITH COMPOUND HEAT-INSULATING LAYER

(76) Inventors: Ping Qu, Jiangsu (CN); Xinfu Chen, Jiangsu (CN)

( * ) Notice: Subject to any disclaimer, the term of this patent is extended or adjusted under 35 U.S.C. 154(b) by 51 days.

(21) Appl. No.: 12/089,753

(22) PCT Filed: Apr. 12, 2007

(86) PCT No.: PCT/CN2007/001190

§ 371 (c)(1),
(2), (4) Date: Apr. 10, 2008

(87) PCT Pub. No.: WO2007/134519

PCT Pub. Date: Nov. 29, 2007

(65) Prior Publication Data

US 2009/0056259 A1 Mar. 5, 2009

(51) Int. Cl.
*E04C 3/30* (2006.01)

(52) U.S. Cl. ..... 52/574; 52/794.1

(58) Field of Classification Search ..... 52/574, 52/604, 319, 794.1, 405.1, 236.7
See application file for complete search history.

(56) References Cited

U.S. PATENT DOCUMENTS

| | | | | | |
|---|---|---|---|---|---|
| 1,388,181 | A | * | 8/1921 | Guimonneau | 52/571 |
| 1,428,470 | A | * | 9/1922 | Brainerd | 52/605 |
| 2,208,589 | A | * | 7/1940 | Leemhuis | 52/293.1 |
| 4,123,881 | A | * | 11/1978 | Muse | 52/100 |
| 4,815,243 | A | * | 3/1989 | Pardo | 52/100 |
| 5,673,525 | A | | 10/1997 | Keith et al. | |
| 5,820,305 | A | * | 10/1998 | Taylor et al. | 405/286 |

FOREIGN PATENT DOCUMENTS

| | | |
|---|---|---|
| CN | 1408970 | 4/2003 |
| DE | 3011682 | 10/1981 |
| FR | 2511061 | 2/1983 |
| FR | 2598449 | 11/1987 |

* cited by examiner

*Primary Examiner* — Jeanette E Chapman
*Assistant Examiner* — Daniel Kenny
(74) *Attorney, Agent, or Firm* — Schmeiser, Olsen & Watts, LLP

(57) ABSTRACT

A concrete load-bearing wall with compound heat-insulating layer includes wall body (1) and connecting beam (2). Two layers of prefabricated heat-insulating concrete wall bodies (11*a*, 11*b*) are set in the wall body (1) of external wall, said prefabricated heat-insulating concrete wall body (11*a*, 11*b*) is a concrete plate (5) whose external surface is covered with a heat-insulating material layer (4), every layer of the prefabricated heat-insulating concrete wall body is composed of several trough-type or L-shaped prefabricated heat-insulating concrete wall body units (13). A concrete wall body vertical rib (12) is cast in situ between two adjacent prefabricated heat-insulating concrete wall body units (13) in same layer and connects them into integrity. The upper and lower ends of the rib (12) connect together with the beam of the floor, and the external side of the connecting beam (2) is covered with the heat-insulating material layer (4).

6 Claims, 3 Drawing Sheets

CONCRETE LOAD-BEARING WALL WITH COMPOUND HEAT-INSULATING LAYER

TECHNICAL FIELD

This invention relates to a type of concrete building, in particular a concrete load-bearing wall with compound heat-insulating layer

BACKGROUND OF THE INVENTION

Existing low buildings and multistory buildings are mostly masonry building or concrete frame building. Minor high-rise buildings of height less than 50 m are mostly concrete building. Present masonry building structure system normally has poor antiseismic properties and mostly uses clay bricks. Large amount of clay resource is used, seriously damaging farmland and affecting sustainable development of agriculture. Present concrete buildings mostly adopt cast-in-place concrete structure system. Large amount of timber needs to be used to fabricate formwork, seriously exhausting forest resource and affecting environment and climate.

All existing masonry buildings and cast-in-place concrete building structures adopt site construction involving high manual labor strength, low level of factory production, many sequences, high costs and long construction period.

Existing building energy conservation technology has been developed without changing existing building structure system. Heat insulation technology includes exterior wall exterior heat insulation and exterior wall interior heat insulation. In the former technology, heat insulation layer is added on outdoor surface of exterior wall; in the latter technology, heat insulation layer is added on inner surface of exterior wall. In terms of material, heat insulation layer can be of plate material or slurry material. No matter plate or slurry, existing building exterior wall energy conservation technology has the apparent disadvantages of many sequences, high cost, poor effect, low safety, service life shorter than 15 years, and unsuitability on interior wall etc.

From nineteen forties to nineteen seventies, large concrete slab buildings appeared home and abroad. In such buildings, complete concrete wall slabs and floor slabs are used as basic members of building, so as to realize factory production and assembling installation. To save materials, large porous concrete slab building was invented in China; however, such building has poor overall performance and cannot satisfy comfort requirements as proven by practice.

DETAILED DESCRIPTION

The purpose of the present invention it to provide a vertical load-bearing wall of self-heat insulated concrete building structure system with high performance concrete structure material and high efficiency heat insulation material as main materials, to overcome aforesaid defects of existing technology provided that basic state policies of antiseismic properties, energy saving, land saving, environmental protection, no use of clay bricks, less use of wood formwork and saving of non-renewable resources are fully satisfied. This structure system is suitable for factory production and mechanized construction, and safe, reliable and cheap. Service life reaches 50 years.

Technical scheme of this invention: A type of concrete load-bearing wall with compound heat-insulating layer, comprising wall and link beam. Two layers of prefabricated concrete wall for heat insulation will be used inside exterior wall. Prefabricated concrete wall for heat insulation is concrete panel with inner surface covered with heat insulation layer. Each layer of prefabricated concrete wall for heat insulation comprises a number of trough-type or L shaped prefabricated concrete wall units for heat insulation. Between two neighboring such units on the same layer, cast-in-place concrete wall vertical ribs are used to connect them to an integral. Two such units in two neighboring layers shall be arranged in a crossed way with opposing notches. Top of groove rib of the unit in one layer shall mate bottom of groove in the unit in the other layer. At intersection between link beam and wall, prefabricated concrete panels for beat insulation are arranged on link beam. Upper and lower ends of vertical rib of cast-in-place concrete wall shall be connected to floor beam. Outer wall end face of said link beam is covered with heat insulation layer.

Aforesaid wall can be partially heat insulating or completely heat insulating.

At wall corners and at intersection between interior and exterior walls, cast-in-place concrete wall end columns are provided. Side face at intersection between wall and end column will be covered with heat insulation layer. Cast-in-place concrete wall end column connects a number of walls together.

In this invention, outer surface of prefabricated concrete panel for insulation used as wall is provided with ornamental motif or grooves for embedded pipelines, to replace additional (stuck) facing or avoid secondary cutting of grooves on wall surface, thereby saving investment and facilitating construction.

Concrete panel used for said prefabricated concrete wall for heat insulation adopts prestressed concrete or reinforced concrete. Material of said heat insulation layer can be polystyrene foam or other organic foam. Said cast-in-place concrete wall and floor adopt reinforced concrete.

In this invention, trough-type or L-shaped prefabricated concrete panel for heat insulation is used as permanent formwork. Concrete wall of secondary folded casting is used as vertical ribs. Upper and lower end of vertical rib are connected with floor beam, constituting frame type load-bearing wall. Trough-type and L-shaped prefabricated concrete panels for heat insulation not only function as formwork, but also work together with folded and cast vertical ribs to form vertical load-bearing member of good ductility and strong resistance against horizontal load. Such member can be used for main structure of both low and multistory residence building, and minor high-rise residence building of height not exceeding 50 m.

In this invention, heat insulation layer is provided inside concrete wall, and on outer side of link beam, effectively blocking shortcut of heat transfer and providing good heat insulation. At the same time, during construction, prefabricated concrete wall and floor slab are used as permanent formwork for cast-in-place concrete members, and cast to be an integral with cast-in-place concrete members, reducing construction sequences, shortening construction period, simplifying process, and reducing costs.

This invention provides a new energy saving building structure system, in which (factory) prefabricated concrete members for heat insulation is used as exterior wall and household division wall, and also used as formwork for cast-in-place concrete part. This formwork needs not be removed and constitutes a permanent part of folded concrete wall structural system for heat insulation. With this technology, heat insulation performance of cast-in-place concrete building structure system has been improved, in line with development trend of building energy conservation. In addition, construction sequences have been reduced, and construction period shortened, reducing cost and solving the problem of complicated process of energy saving buildings.

In this invention, prefabricated concrete wall for heat insulation are used to help positioning of cast-in-place concrete vertical ribs and stubs, so that cast-in-place concrete furring strips, stirrups and longitudinal rebar interact with prefabricated concrete members, to meet structural requirements, enhance integrity of prefabricated concrete members with cast-in-place concrete members, replace masonry load-bearing wall, and enhance structural antiseismic performance.

This invention favors integrated design, modular production and installation, improved construction quality and accurate control of construction period. In addition, dry site operation can be performed, realizing factory fabrication of concrete buildings.

With this invention, buildings can more easily meet energy conservation standard, and obtained improved sound insulation and heat insulation performance. No separate heat insulation layer is required for the walls, hence room yield rate is high and secondary fitment is favored.

1—wall 2—link beam 4—heat insulation layer 5—concrete panel 6—cast-in-place concrete wall end column 11—prefabricated concrete wall for heat insulation 12—cast-in-place concrete wall 13—prefabricated concrete unit for heat insulation

PREFERRED EMBODIMENT 1

Figure 1:
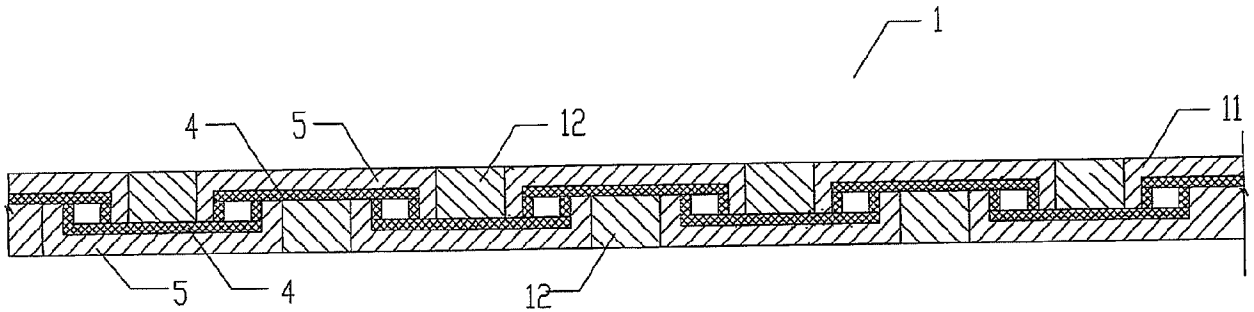
FIG. 1 is a structural schematic of wall of preferred embodiment of this invention.
Figure 2:
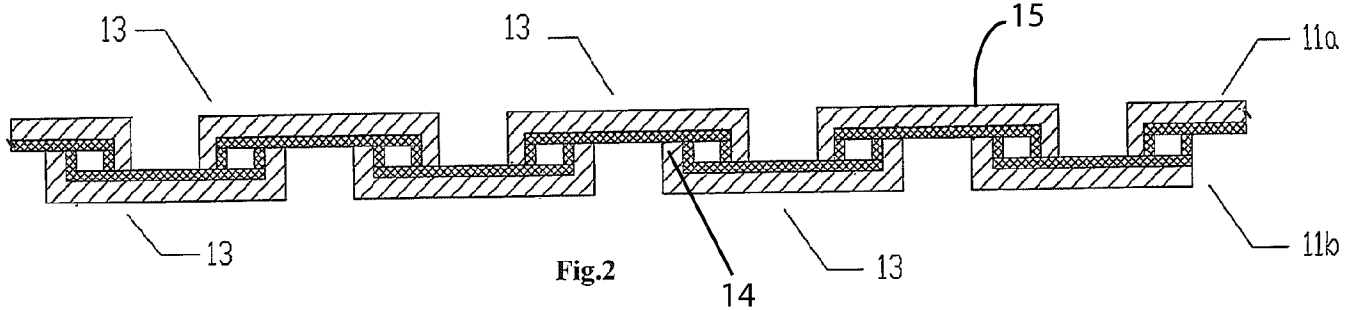
FIG. 2 is a structural schematic of prefabricated concrete panel for heat insulation of preferred embodiment 1 of this invention.
Figure 5:
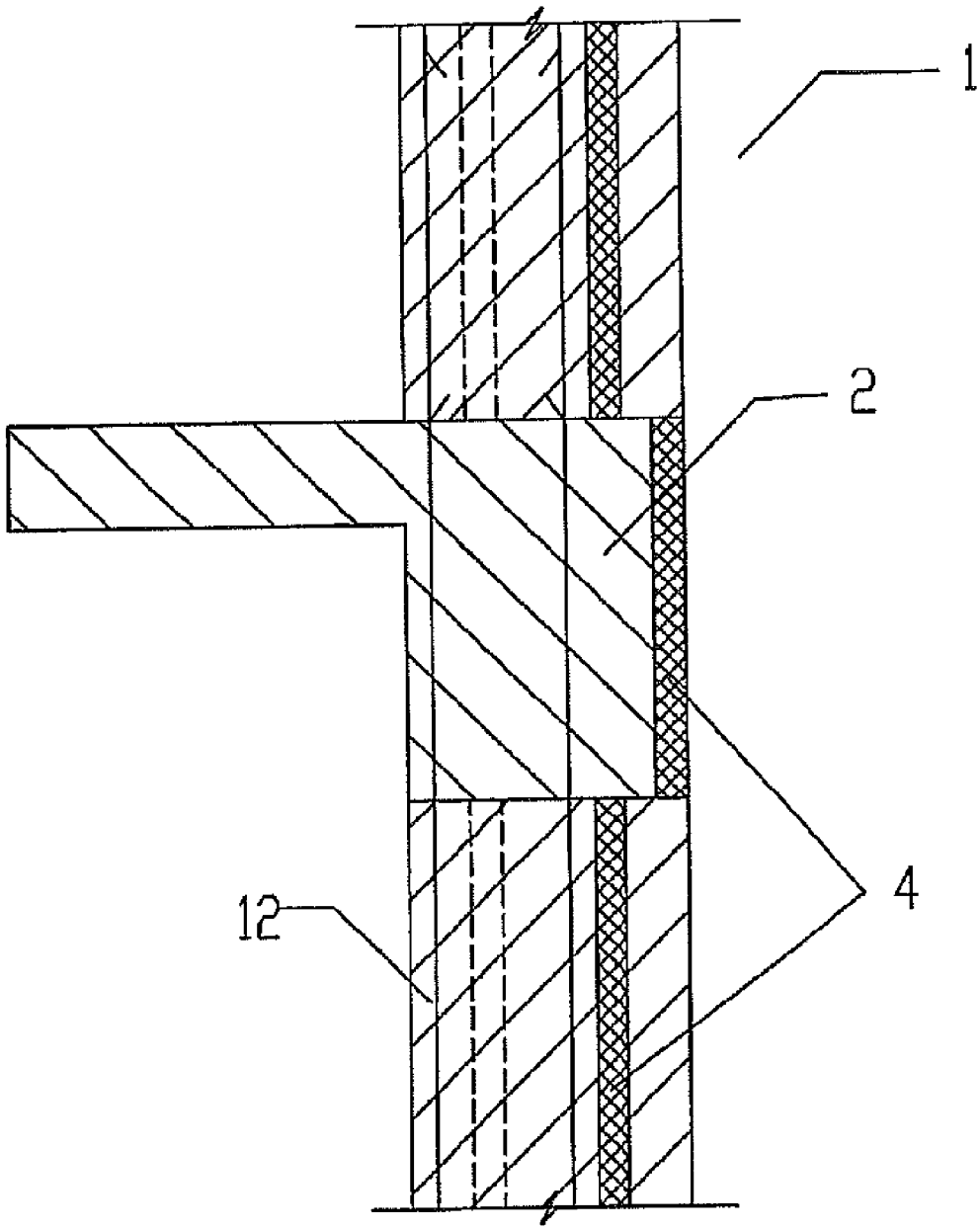
FIG. 5 is a structural schematic of wall and link beam node of preferred embodiment 1 of this invention.

Referring to FIG.5, with additional reference to FIG.1 and FIG.2, an embodiment of a concrete load-bearing wall with compound heat-insulating layer, comprising a wall 1 and a link beam 2 is described. Two layers of prefabricated concrete wall for heat insulation 11*a* and ll*b* will be used inside wall 1. Prefabricated concrete wall for heat insulation 11*a*, ll*b* is concrete panel 5 with heat insulation layer 4 on its interior surface. Each layer of prefabricated concrete wall for heat insulation 11*a*, ll*b* comprises a number of trough-type or L shaped prefabricated concrete wall units for heat insulation 13. Between two neighboring such units 13 on the same layer, cast-in-place concrete wall vertical ribs 12 are used to connect them to an integral. Two such units 13 in two neighboring layers shall be arranged in a crossed way with opposing notches. Top of groove rib of the unit 13 in prefabricated concrete wall layer 11*a* shall mate bottom of groove in the unit 13 in prefabricated concrete wall layer 11*b*.

Refer to FIG. 5. At intersection between link beam 2 and exterior wall 1, prefabricated concrete wall for heat insulation is provided on link beam 2. Cast-in-place link beam 2 and upper and lower ends of vertical ribs 12 of cast-in-place concrete wall are cast to be an integral. Outer end face of link beam 2 is covered with heat insulation layer 4.

Figure 3:
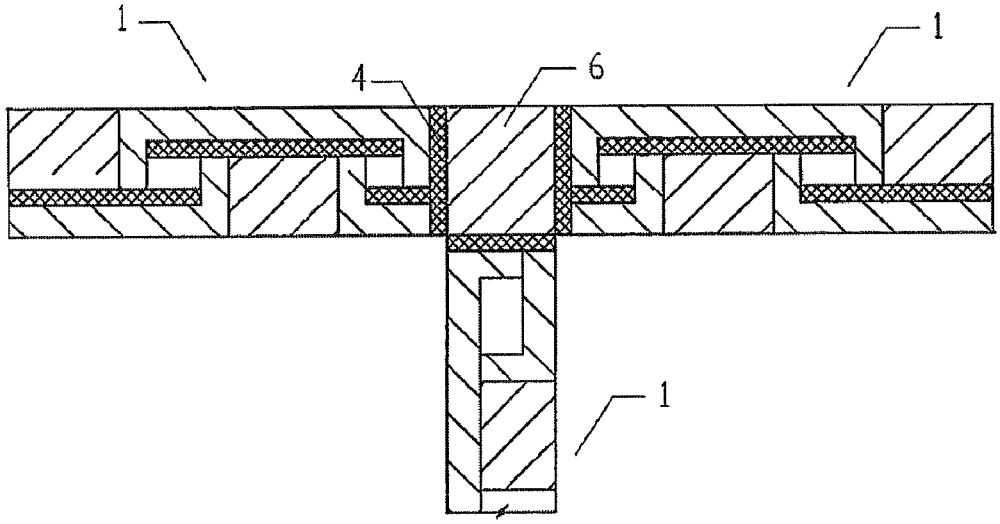
FIG. 3 is a structural schematic of wall corner of preferred embodiment 1 of this invention.

Refer to FIG. 3. At wall corners, cast-in-place concrete wall end column 6 is provided. Side face of intersection between wall 1 and end column is covered with heat insulation layer 4. Cast-in-place concrete wall end column 6 connects two walls 1 together.

Figure 4:
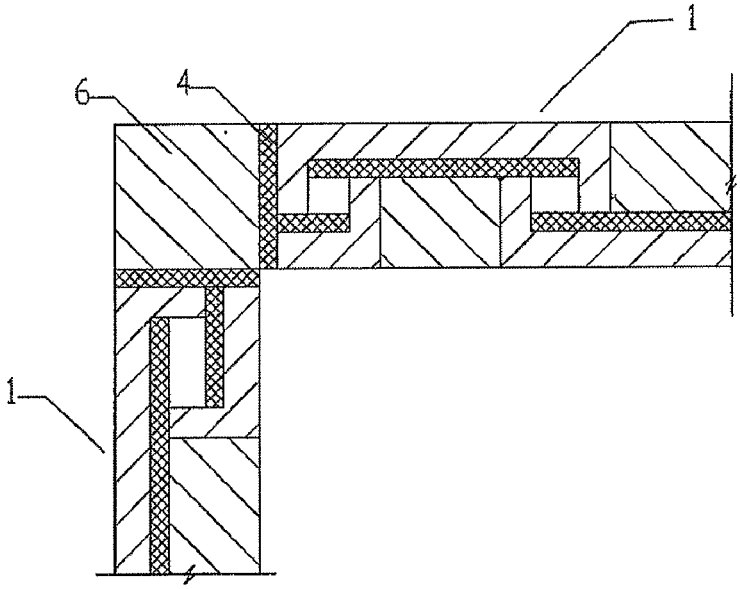
FIG. 4 is a structural schematic of intersection between interior wall and exterior wall of preferred embodiment 1 of this invention.

Refer to FIG. 4. At intersection between interior wall and exterior wall, cast-in-place concrete wall end column 6 is provided. Side face of intersection between wall and end column is covered with heat insulation layer 4. Cast-in-place concrete wall end column 6 connects 3 walls together.

This invention is applicable to low, multistory and minor high-rise concrete building of height less than 50 m.

What is claimed is:

1. A concrete load-bearing wall comprising:

a first layer of prefabricated concrete panels spaced apart by a first plurality of cast-in-place concrete wall vertical ribs, wherein each of the prefabricated concrete panels of the first layer of prefabricated concrete panels have at least two protruding edges;

a second layer of prefabricated concrete panels spaced apart by a second plurality of cast-in-place concrete wall vertical ribs disposed therein, wherein each of the prefabricated concrete panels of the second layer of prefabricated concrete panels have at least two protruding opposing edges, further wherein the second layer of prefabricated concrete panels is positioned opposite the first layer of prefabricated concrete panels such that each of the prefabricated concrete panels of the first layer of prefabricated concrete panels overlap a portion of at least one prefabricated concrete panel of the second layer of prefabricated concrete panels; and a heat insulating layer covering an inner surface of each of the prefabricated concrete panels to form a continuous heat insulating barrier, the heat insulating layer conforming to the inner surface of the prefabricated concrete panels, wherein a union of the heat insulating layer and the prefabricated concrete panels form a prefabricated concrete unit;

wherein the prefabricated concrete unit formed by the union of the heat insulating layer and the prefabricated concrete panels of the first layer is cross-linked with the prefabricated concrete unit formed by the union of the heat insulating layer and the prefabricated concrete panels of the second layer, such that the at least two protruding edges of the prefabricated concrete panels of the first layer of prefabricated concrete panels contact the prefabricated concrete unit formed by the union of the heat insulating layer and the prefabricated concrete panels of the second layer, forming a single, heat insulated wall.

2. The concrete load-bearing wall with compound heat-insulating layer of claim 1, wherein at an intersection between a link beam and at least one heat insulated wall, the prefabricated concrete panels for heat insulation are arranged on the link beam, further wherein an upper end and a lower end of the heat insulated wall are connected to a floor beam, and an outer wall end face of said link beam is also covered with the heat insulation layer.

3. The concrete load-bearing wall of claim 1, wherein the link beam is connected to the heat insulated wall, wherein an outer surface is covered by the heat insulating layer.

4. The concrete load-bearing wall of claim 1, wherein a cast-in-place concrete end column is positioned at a corner junction between more than one heat insulated wall to connect the more than one heat insulated walls together, wherein the intersection between the heat insulated walls and the cast-in-place concrete end column is also covered with the heat insulating layer.

5. The concrete load-bearing wall of claim 1, wherein the cast-in-place concrete end column is positioned at an intersection between more than one heat insulated wall to connect the more than one heat insulated wall together, wherein each face of the cast-in-place end column contacting the heat insulated wall is also covered with heat the insulating layer.

6. The concrete load-bearing wall of claim 1, wherein at least one ornamental motif or groove for embedded pipeline is provided on an outer surface of the prefabricated concrete panels.

* * * * *